US008708440B2

(12) United States Patent
Nagase

(10) Patent No.: US 8,708,440 B2
(45) Date of Patent: Apr. 29, 2014

(54) INK JET PRINTING APPARATUS AND METHOD OF MANUFACTURING PRINTED GOODS USING INK JET PRINTING APPARATUS

(75) Inventor: Makoto Nagase, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 95 days.

(21) Appl. No.: 13/301,064

(22) Filed: Nov. 21, 2011

(65) Prior Publication Data

US 2012/0127223 A1 May 24, 2012

(30) Foreign Application Priority Data

Nov. 24, 2010 (JP) ..... 2010-261485
Nov. 25, 2010 (JP) ..... 2010-262187

(51) Int. Cl.

| | |
|---|---|
| ***B41J 29/38*** | (2006.01) |
| ***B41J 11/00*** | (2006.01) |
| ***B41J 29/17*** | (2006.01) |
| *B41J 3/407* | (2006.01) |

(52) U.S. Cl.

CPC ..... *B41J 11/0015* (2013.01); *B41J 29/17* (2013.01); *B41J 3/4078* (2013.01)

USPC ..... 347/6

(58) Field of Classification Search

CPC .... B41J 2/17593; B41J 11/0015; B41J 29/17; B41J 3/4078

USPC ..... 347/6, 20, 22, 33–35, 102, 103

See application file for complete search history.

(56) References Cited

U.S. PATENT DOCUMENTS

| | | | | |
|---|---|---|---|---|
| 5,847,729 | A * | 12/1998 | Takahashi et al. | 347/43 |
| 6,767,092 | B2 * | 7/2004 | May et al. | 347/103 |
| 7,497,564 | B2 * | 3/2009 | Yui | 347/101 |
| 8,177,352 | B2 * | 5/2012 | Fioravanti et al. | 347/103 |
| 2003/0067529 | A1 | 4/2003 | May et al. | |
| 2010/0077554 | A1 | 4/2010 | Izawa et al. | |

FOREIGN PATENT DOCUMENTS

| | | |
|---|---|---|
| CN | 1403651 | 3/2003 |
| CN | 101713156 | 5/2010 |
| JP | 2003-293272 | 10/2003 |
| JP | 2007-100257 | 4/2007 |

* cited by examiner

*Primary Examiner* — An Do
(74) *Attorney, Agent, or Firm* — Workman Nydegger

(57) ABSTRACT

An ink jet printing apparatus includes a printing unit having a printing head that discharges an ink onto a surface of a material to be subjected to printing being transported by a transport device to thereby print a predetermined pattern, and an ink fixing unit that solidifies and fixes the ink applied to the material, the fixing unit being located downstream of the printing unit in a transport direction of the material, and an ink removal unit that removes, in the case where the material has a nap on a surface thereof and a pigment ink is employed for printing, an unsolidified ink stuck to the nap. The ink removal unit is located between the printing unit and the ink fixing unit, and includes an ink removing element that contacts the nap on the surface so as to remove the ink stuck to the nap.

15 Claims, 15 Drawing Sheets

FIG. 14

| SAMPLE | WHITE COTTON CLOTH FOR ABRASION | SPECIMEN |
|---|---|---|
| DRY ABRASION<br>S3C-323<br>WITH SCRAPING<br>OD VALUE: 0.29 | 41D | T1 |
| WET ABRASION<br>S3C-323<br>WITH SCRAPING<br>OD VALUE: 0.33 | 41W | T1 |
| DRY ABRASION<br>S3C-323<br>WITHOUT SCRAPING<br>OD VALUE: 0.29 | 41D | T2 |
| WET ABRASION<br>S3C-323<br>WITHOUT SCRAPING<br>OD VALUE: 0.55 | 41W | T2 |

INK JET PRINTING APPARATUS AND METHOD OF MANUFACTURING PRINTED GOODS USING INK JET PRINTING APPARATUS

This application claims the benefit of both Japanese Patent Application No. 2010-261485, filed on Nov. 24, 2010, and Japanese Patent Application No. 2010-262187, filed on Nov. 25, 2010, which are hereby incorporated by reference herein in their entirety.

BACKGROUND

1. Technical Field

The present invention relates to an ink jet printing apparatus that includes a printing unit having a printing head that discharges an ink toward a print-side surface of a material to be subjected to printing being transported thereby executing desired printing, and an ink fixing unit located downstream of the printing unit in a direction in which the printing unit is transported (hereinafter, transport direction), for solidifying and fixing the ink applied to the material to be subjected to printing, and to a method of manufacturing printed goods by an ink jet printing process.

2. Related Art

Printing techniques for printing a pattern on a surface of a fabric have been widely employed by apparel (garments) manufacturers and textile (fabric) manufacturers.

Conventional printing methods can be typically represented by screen printing and roller printing, which include a plate making process that utilizes screens or engraving rolls. In relation to this, a "cloth surface finishing method" has been developed, for example as disclosed in JP-A-2007-100257, that employs a laser beam to flatten the surface of a material to be subjected to printing, specifically a cloth, so as to draw a pattern thereon without forming a molten mass on the printed cloth.

In addition, an "ink jet printing method" has also been developed, for example as disclosed in JP-A-2003-293272, that includes applying a dye ink discharged from a printing head directly onto a material to be subjected to printing for printing a record thereon, for which the plate making process is not required.

The ink jet printing method also includes heat-pressing the material to be subjected to printing with a heat-press machine, an iron, or the like, to thereby steam-fix the dye ink applied to the cloth surface.

Since the material to be subjected to printing is a cloth, normally naps are present on the surface thereof. Also, there are cloths that are subjected to a raising process for increasing the number of naps on the surface, to thereby obtain a softer touch and texture, and further to improve heat retention.

In the case where ink jet printing is performed on the material to be subjected to printing having naps, a part of an ink droplet discharged from the printing head may adhere to a nap so as to form an "ink lump", before reaching the base surface of the material to be subjected to printing, i.e., the cloth. The ink lump, if dried and solidified on the nap, degrades abrasion resistance of the cloth and thereby encourages color migration.

Further, since the ink lump is stuck to the nap which is raised from the cloth structure surface, the ink lump is located above the dyeing position on the cloth structure surface where the ink was supposed to land. Accordingly, the presence of the ink lump may degrade the quality of the printed goods.

The foregoing problem tends to appear more prominently with pigment inks which are larger in particle diameter than dye inks.

In the case where the techniques according to JP-A-2007-100257 and JP-A-2003-293272 are applied to a printing process on a material to be subjected to printing having naps, the raised naps are removed or depressed, which leads to significant degradation in touch or texture that the material to be subjected to printing initially had.

When performing a printing process on a material to be subjected to printing having naps, maintaining the natural feeling of the material to be subjected to printing such as the touch or texture is not less important, from the viewpoint of quality evaluation of the printed goods, than reproducing the pattern or image clearly.

SUMMARY

An advantage of some aspects of the invention is that a printing apparatus is provided that allows unsolidified ink stuck to a nap on a surface of a cloth to be subjected to printing to be removed while the nap remains in a raised state.

In an aspect, the invention provides an ink jet printing apparatus includes a printing unit having a printing head that discharges an ink onto a print-side surface of a material to be subjected to printing being transported by a transport device, to thereby print a predetermined pattern, and an ink fixing unit that solidifies and fixes the ink applied to the material to be subjected to printing, the fixing unit being located downstream of the printing unit in a transport direction, and an ink removal unit that removes, in the case where the material to be subjected to printing is a cloth having a nap on a base surface thereof and a pigment ink is employed for printing, an unsolidified ink stuck to the nap, the ink removal unit being located between the printing unit and the ink fixing unit, wherein the ink removal unit includes an ink removing element that contacts the nap on the cloth structure surface so as to remove the ink stuck to the nap.

Here, the "material to be subjected to printing" includes cloths and apparel goods such as clothes and garments that can be an object of the printing process. The "cloths" include woven fabrics, knitted fabrics, non-woven cloths, and the like, made of a natural fiber such as cotton, silk, wool and so on, or a synthetic fiber such as nylon, and of a composite fiber thereof. The cloths may be either continuously rolled or cut in a predetermined length.

The "apparel goods" include sewn T-shirts, handkerchiefs, scarves, towels, shopping bags, cloth bags, furniture such as curtains, sheets, bed covers, and also the material cloth constituting the parts of the cited goods yet to be cut or sewn.

The "cloth structure surface" refers to the surface of the main structure of the material to be subjected to printing, i.e., the surface of the structure formed by interlacing fiber yarns with or without undergoing a weaving or knitting process, so as to present the basic appearance of the material to be subjected to printing.

The "nap" includes those formed by a raising process performed on the cloth structure surface, as well as those that spontaneously emerge through the weaving process or other manufacturing processes.

In the foregoing apparatus, the ink removal unit is located between the printing unit and the ink fixing unit, and includes the ink removing element to be brought in contact with naps on the cloth structure surface of the material to be subjected to printing so as to remove the ink stuck to the naps. Therefore, the unsolidified ink stuck to the naps on the cloth structure surface of the material to be subjected to printing can be removed, maintaining the naps in the raised state.

More specifically, the ink removing element is brought into contact with the naps without applying thereto a heavy pressure that depresses and flattens the naps onto the cloth structure surface. Thus, although the naps temporarily tilt upon being contacted by the ink removing element, the naps can immediately recover the initial raised state. Then the ink fixing unit fixes the ink applied to the material to be subjected to printing having naps thus restored, and consequently the naps can remain in the raised state on the finished printed goods.

Here, the expression "maintaining the naps in the raised state" represents the case where printing is performed without depressing and flattening the naps from the raised state, and includes such a case that some naps naturally tilt or collapse owing to the self weight or for some other reason, in the printing process.

Removing thus the ink stuck to naps with the ink removing element maintaining the naps in the raised state prevents color migration arising from degradation in abrasion resistance, and allows the material to be subjected to printing having naps to keep the natural touch and texture thereof.

In another aspect, the ink removal unit may include the ink removing element to be brought into contact with the nap on the cloth structure surface of the material to be subjected to printing to thereby remove the ink stuck to the nap, and the ink removing element may be attached to the printing head or the carriage. In this case, the unsolidified ink stuck to the naps on the cloth structure surface of the material to be subjected to printing can be removed without collapsing the raised state of the naps, utilizing the reciprocating movement of the carriage.

Further, since the ink is removed immediately after the ink is discharged from the printing head and an ink lump is formed on the nap, excellent ink removing effect can be obtained. Here, the ink removing element is brought into contact with naps without applying thereto a strong pressure that depresses and flattens the nap onto the cloth structure surface. Thus, although the naps temporarily tilt upon being contacted by the ink removing element, the naps can immediately recover the initial raised state. Then the ink fixing unit fixes the ink applied to the material to be subjected to printing having naps thus restored, and consequently the naps can remain in the raised state in the finished printed goods.

In another aspect, the ink jet printing apparatus may further include a control unit that controls an operation of the transport device, the printing unit, the ink fixing unit, and the ink removal unit, and the control unit may be configured to select whether to execute ink removal by using the ink removal unit.

In this case, the control unit is configured to select whether to execute ink removal by using the ink removal unit, which allows the ink removal unit to be activated only when certain abrasion resistance has to be secured, and to remain unactivated when abrasion resistance is not a critical factor regardless of whether the material to be subjected to printing has naps. Such an arrangement allows execution of a printing process free from restriction that may be imposed in the case where the ink removal unit is activated, which leads, for example, to a faster printing speed.

In still another aspect, a gap between the ink removing element and the cloth structure surface of the material to be subjected to printing may be adjustable by manual operation or by a control signal from the control unit.

Such a configuration allows a contact height of the ink removing element with respect to the naps to be adjusted, in accordance with the length or nature of the naps of the material to be subjected to printing. In other words, the mounting position of the ink removing element can be adjusted to an optimum contact height for effectively removing the ink stuck to the naps of the material to be subjected to printing, and therefore the ink jet printing apparatus can be applied to various materials to be subjected to printing that are different in nap length or in other aspects.

In still another aspect, the ink removing element may be provided so as to contact the nap, without contacting the cloth structure surface of the material to be subjected to printing.

The cloth itself is slightly wavy because of its nature, and hence the cloth structure surface inevitably includes small recessed or protruding portions. Accordingly, the expression "without contacting the cloth structure surface" includes the state where the ink removing element is in slight contact with the cloth structure surface to such an extent that the material to be subjected to printing can be transported substantially free from resistance, in addition to the state where the ink removing element is completely separated from the cloth structure surface.

Such a configuration allows the ink stuck to naps to be effectively removed, keeping the ink removed by the ink removing element from adhering again to the cloth structure surface of the material to be subjected to printing, on which information such as the image has been recorded. In addition, since the ink removing element is kept from contacting the cloth structure surface, the material to be subjected to printing being transported in a predetermined transport direction is substantially free from transport resistance that may otherwise be exerted by the ink removing element. Consequently, high-quality printed goods can be obtained by the smooth transport of the material to be subjected to printing.

In still another aspect, the contact height of the ink removing element with respect to the nap may be arranged so as to gradually increase from an initial contact point toward a peak contact point, and to gradually decrease from the peak contact point toward a last contact point.

In this case, the contact force of the ink removing element with respect to the naps gradually increases from the contact start point toward the peak contact point, and gradually decreases from the peak contact point toward the contact end point.

Such an arrangement prevents naps in the raised state from being abruptly inclined, so that the naps can gently increase the tilting angle, so as to recover the original raised state after the ink removal process. Further, the transition of the contact force contributes to efficiently removing the ink stuck to naps.

In still another aspect, the ink removing element may include a driving roller having a rotary shaft oriented in a direction intersecting the transport direction of the material to be subjected to printing, and the driving roller may be driven so as to rotate in the transport direction of the material to be subjected to printing at a predetermined speed.

Such a configuration enables the gentle transition of the tilting angle of naps to be achieved with a simple structure.

In addition, rotating the driving roller, serving as the ink removing element, in the same direction as the transport direction of the material to be subjected to printing allows the ink stuck to naps to be removed while the material to be subjected to printing is being smoothly transported free from transport resistance.

Further, the contact force of the driving roller with respect to the naps can be adjusted as desired, by controlling the rotation speed of the driving roller.

In still another aspect, the ink removing element may be provided on a transport route where the print-side surface of the material to be subjected to printing is oriented downward.

Here, the "transport route where the print-side surface of the material to be subjected to printing is oriented downward" includes both a horizontally reversed transport route where the print-side surface is oriented vertically downward and an obliquely reversed transport route where the print-side surface is oriented obliquely downward.

In this case, the ink removed from the naps by the ink removing element is kept from adhering to the material to be subjected to printing, since the removed ink can only fall downward. Thus, since the ink removed from the naps is prevented from adhering again to the material to be subjected to printing, high-quality printed goods can be obtained.

Also, the removed ink flows downward along the surface of the ink removing element. Accordingly the ink can be easily collected, without remaining on or sticking to the working surface of the ink removing element.

In still another aspect, the ink jet printing apparatus may further include a cleaning mechanism that removes ink stuck to the ink removing element.

In this case, the working surface of the ink removing element is properly cleaned by the cleaning mechanism while the ink removing element keeps removing the ink, and hence the ink removing element can be prevented from degrading the ink removal performance. Therefore, the ink removing element can continue substantially maintenance-free operation.

In still another aspect, the ink removal unit may include a soft sheet capable of absorbing ink, and a sheet transport device that transports the soft sheet in the transport direction of the material to be subjected to printing keeping the soft sheet in contact with the nap of the material to be subjected to printing.

In this case, since the sheet transport device transports the soft sheet, which absorbs the ink, in the transport direction of the material to be subjected to printing keeping the soft sheet in contact with the naps of the material to be subjected to printing, the ink stuck to the naps is absorbed by the soft sheet thus to be removed. In addition, the soft sheet gradually shifts the working portion of the ink-absorbing surface in the transport direction of the material to be subjected to printing, so that the ink-absorbing position of the soft sheet is renewed while contacting the naps, so as to efficiently absorb the ink from the naps.

Further, since the soft sheet renews the ink-absorbing position while being transported in contact with the naps as mentioned above, the soft sheet can absorb the ink through a light contact with the naps, thereby facilitating the naps to maintain the original raised state.

In still another aspect, the ink jet printing apparatus may further include a nap raising device located upstream of the printing unit and configured to raise the nap of the material to be subjected to printing.

In this case, the nap raising device raises the naps of the material to be subjected to printing so as to improve the uniformity of the raised state of naps, before the ink is discharged onto the print-side surface of the material to be subjected to printing. Such an arrangement reduces influence of uneven raised state of naps, when ink droplets land on the print-side surface of the material to be subjected to printing having naps. In other words, uniformity in landing performance of the ink droplets on the naps and the cloth structure surface can be improved.

In the case where the material to be subjected to printing has a relatively small amount of naps, it can be expected that majority of the discharged ink directly lands on the cloth structure surface without being disturbed by the naps. Accordingly, the printing quality can be improved, and also the number of ink lumps formed on the naps is reduced and hence the workload of the ink removing element for removing the ink is reduced, which leads to higher ink removing efficiency.

In still another aspect, the invention provides a method of manufacturing printed goods by an ink jet printing process, including discharging an ink onto a print-side surface of a material to be subjected to printing transported to a printing region for the material to be subjected to printing, thereby printing a predetermined pattern, contacting a nap on the print-side surface of the material to be subjected to printing which has undergone the printing process so as to remove unsolidified ink stuck to the nap, and fixing the ink applied to the material to be subjected to printing after removing the ink from the nap.

Such a method allows the ink stuck to the nap to be removed before the ink is solidified, during the series of processes including printing the predetermined pattern on the material to be subjected to printing by the ink jet printing process, removing the unsolidified ink stuck to the nap, and fixing the ink applied to the material to be subjected to printing. Accordingly, printed goods free from defects such as color migration arising from degraded abrasion resistance, hence having high commercial value, can be obtained without compromising the original touch and texture of the material to be subjected to printing having naps.

BRIEF DESCRIPTION OF THE DRAWINGS

The invention will be described with reference to the accompanying drawings, wherein like numbers reference like elements.

FIG. 14 is an explanatory table showing results of comparative tests performed for proving the effect of the ink jet printing apparatus according to the invention.

DESCRIPTION OF EXEMPLARY EMBODIMENTS

Figure 15:
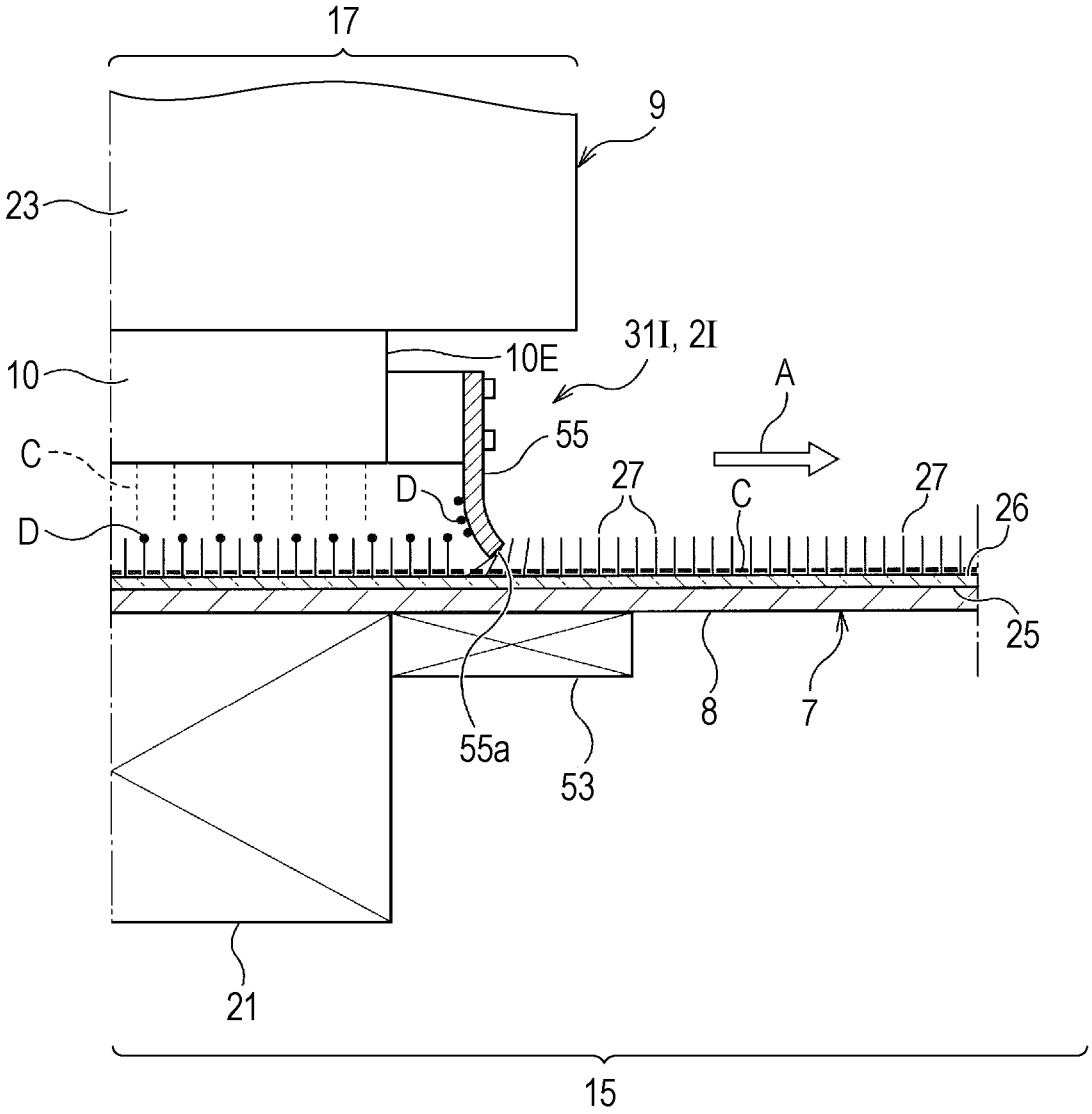
FIG. 15 is an enlarged fragmentary cross-sectional view of an ink jet printing apparatus according to a ninth embodiment.

Hereafter, the structure and operation of an ink jet printing apparatus according to the invention will be described, with reference to a first embodiment shown in FIGS. 1 to 5B, a second embodiment shown in FIG. 6, a third embodiment shown in FIG. 7, a fourth embodiment shown in FIG. 8, a fifth embodiment shown in FIG. 9, a sixth embodiment shown in FIG. 10, a seventh embodiment shown in FIG. 11, an eighth embodiment shown in FIG. 12, and a ninth embodiment shown in FIG. 15, as specific examples.

In the following, the general structure of the ink jet printing apparatus 1 according to the invention and a method of manufacturing printed goods using the ink jet printing apparatus 1 will be first described, and then the above cited embodiments will be described in turn.

Figure 1:
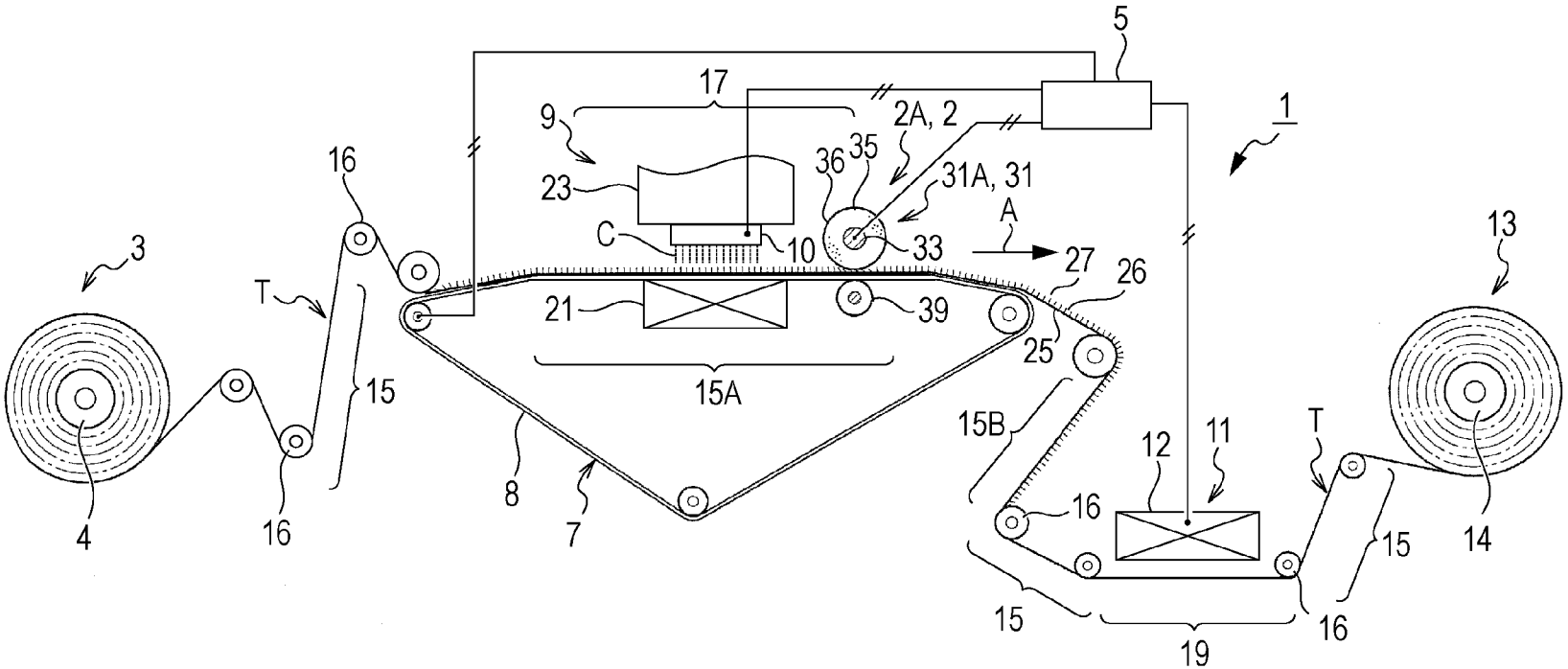
FIG. 1 is a side cross-sectional view showing a general structure of an ink jet printing apparatus according to a first embodiment of the invention.
Figure 13:
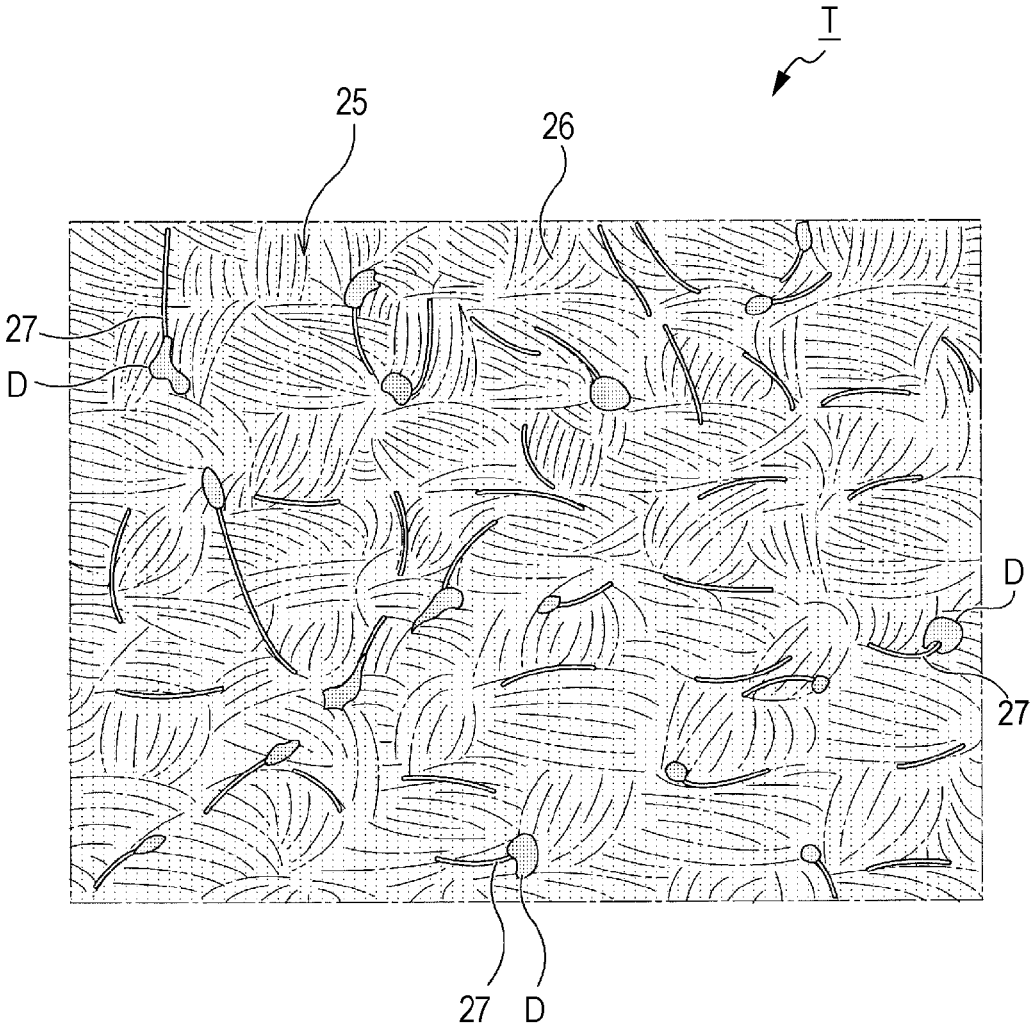
FIG. 13 is a plan view of a material to be subjected to printing immediately after printing with the ink jet printing apparatus according to the invention.

FIG. 1 illustrates the general structure of the ink jet printing apparatus 1. FIG. 13 depicts a material on be subjected to printing T on which an ink C has just been discharged and not yet dried.

The ink jet printing apparatus 1 shown in FIG. 1 is installed to perform printing on the material to be subjected to printing T, for example a lengthy fabric wound in rolls, and a feed mechanism 3 including a feed roller 4 and a takeup mechanism 13 including a takeup roller 14 are provided upstream and downstream of the ink jet printing apparatus 1, respectively, in a transport direction A.

A transport route 15 for the material to be subjected to printing T including a plurality of guide rollers 16 is provided between the feed mechanism 3 and the takeup mechanism 13. A wrinkle release mechanism (not shown) is provided on an upstream side of the transport route 15, to remove wrinkles from the material to be subjected to printing T before printing.

A transport device 7 is provided downstream of the wrinkle release mechanism. The transport device 7 includes a conveyor belt 8 that transports the material to be subjected to printing T from which the wrinkles have been removed to a printing region 17 for the material to be subjected to printing T and to a drying region 19 for the ink C that has been applied to the material to be subjected to printing T.

A printing unit 9 is provided in the printing region 17 for the material to be subjected to printing T. The printing unit 9 includes a printing head 10 that discharges a pigment ink C onto the print-side surface of the material to be subjected to printing T thereby printing a predetermined pattern, and a support member 21 that supports the other surface of the material to be subjected to printing T opposite the print-side surface. The printing head 10 is retained, for example, by a carriage 23 configured to reciprocate in a width direction B (see FIG. 4) of the material to be subjected to printing T, the width direction B intersecting the transport direction A of the material to be subjected to printing T.

In the drying region 19 for the discharged ink C, an after heater 12 constituting an ink fixing unit 11 is provided that dries and fixes the ink C applied to the surface 26 of the main structure 25 of the material to be subjected to printing T.

Further, an ink removal unit 2A according to the first embodiment to be subsequently described is provided between the printing region 17 for the material to be subjected to printing T and the drying region 19 for the discharged ink C. The ink removal unit 2A serves to remove unsolidified ink D stuck to a nap 27 (hereinafter also referred to as an "ink lump" as the case may be) from the surface 26 of the main structure 25 of the material to be subjected to printing T. Hereafter, the ink removal unit will be denoted as 2A when specifically referring to the ink removal unit according to the first embodiment, and denoted simply as 2 when generally referring to the ink removal unit.

Figure 5A:
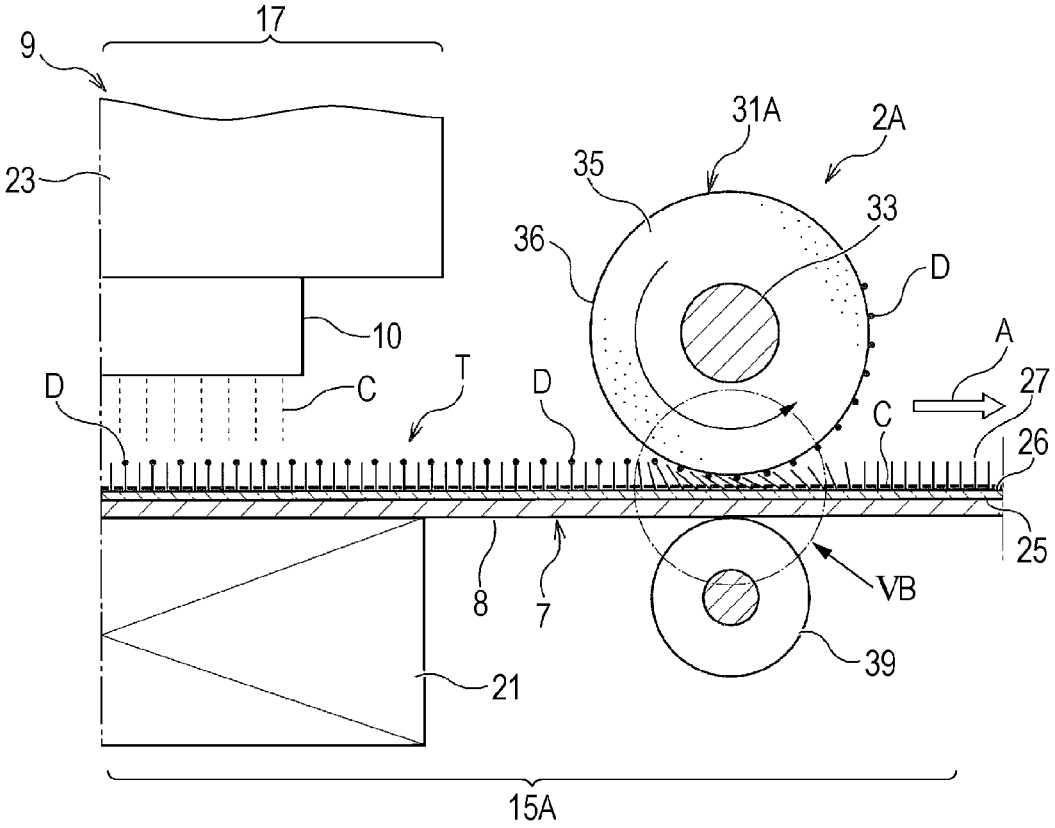
FIG. 5A is a side view for explaining an operation of the ink jet printing apparatus according to the first embodiment.

The ink lump D represents a lump formed of the ink C that has adhered to a tip portion or its vicinity of a nap 27 on the surface 26 of the main structure 25 before reaching the surface 26 as shown in FIGS. 5 and 13, which may result in color migration after the printing process.

Employing the thus-configured ink jet printing apparatus 1 enables printed goods with a high-quality printed pattern to be obtained, without compromising the original touch and texture of the printed goods.

A method of manufacturing printed goods by an ink jet printing process according to the invention includes discharging the pigment ink C onto the print-side surface of a material to be subjected to printing T transported to the printing region 17 for the material to be subjected to printing T, thereby printing a predetermined pattern. Employing the pigment ink C, which firmly settles on the material to be subjected to printing T and barely fades after printing, allows the clarity of the printed pattern to be maintained over a long period of time.

The method of manufacturing the printed goods also includes contacting the nap 27 so as to remove the unsolidified ink lump D stuck to the nap 27 on the print-side surface 26 of main structure 25 of the material to be subjected to printing T which has been subjected to the printing process.

Although the pigment ink C is more prone to form the ink lumps D than a dye ink, the ink lumps D stuck to the nap 27 are removed before solidification, according to the above described method.

Further, the method of manufacturing the printed goods includes heating the material to be subjected to printing T from which the ink lumps D have been removed and which has been transported to the drying region 19 for the discharged ink C, thereby drying and fixing the ink C applied to the material to be subjected to printing T.

The pigment ink C increases fixation strength upon being dried. However the ink lumps D stuck to the nap 27 have already been removed in the preceding process, and therefore printed goods with a high-quality printed pattern can be obtained, without compromising the original touch and texture of the printed goods.

First Embodiment

The ink removal unit 2A according to this embodiment is configured so as to be engaged with the print-side surface of the material to be subjected to printing T at a position between the printing region 17 for the material to be subjected to printing T and the drying region 19 for the discharged ink C.

The ink removal unit 2A essentially includes an ink removing element 31A to be brought into contact with the naps 27 on the surface 26 of the main structure 25 so as to remove the ink lumps D stuck to the naps 27.

The ink jet printing apparatus 1 including the ink removal unit 2A also includes a control unit 5 that controls operations of the transport device 7, the printing unit 9, the ink removal unit 2A, and the ink fixing unit 11. The control unit 5 is configured to select whether to execute ink removal by using the ink removal unit 2A in the case where the material to be subjected to printing T includes the naps 27 on the surface 26 thereof.

Figure 2:
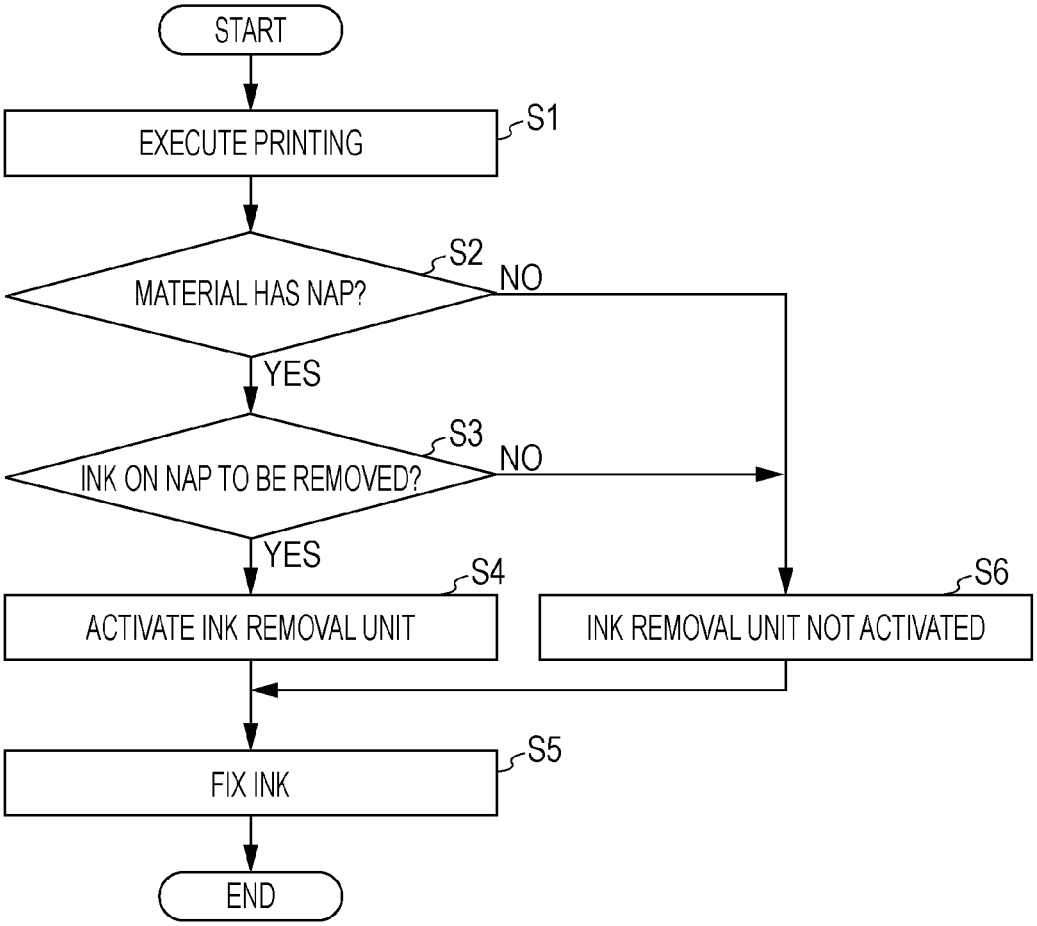
FIG. 2 is a flowchart showing a control process of a printing operation.
Figure 3:
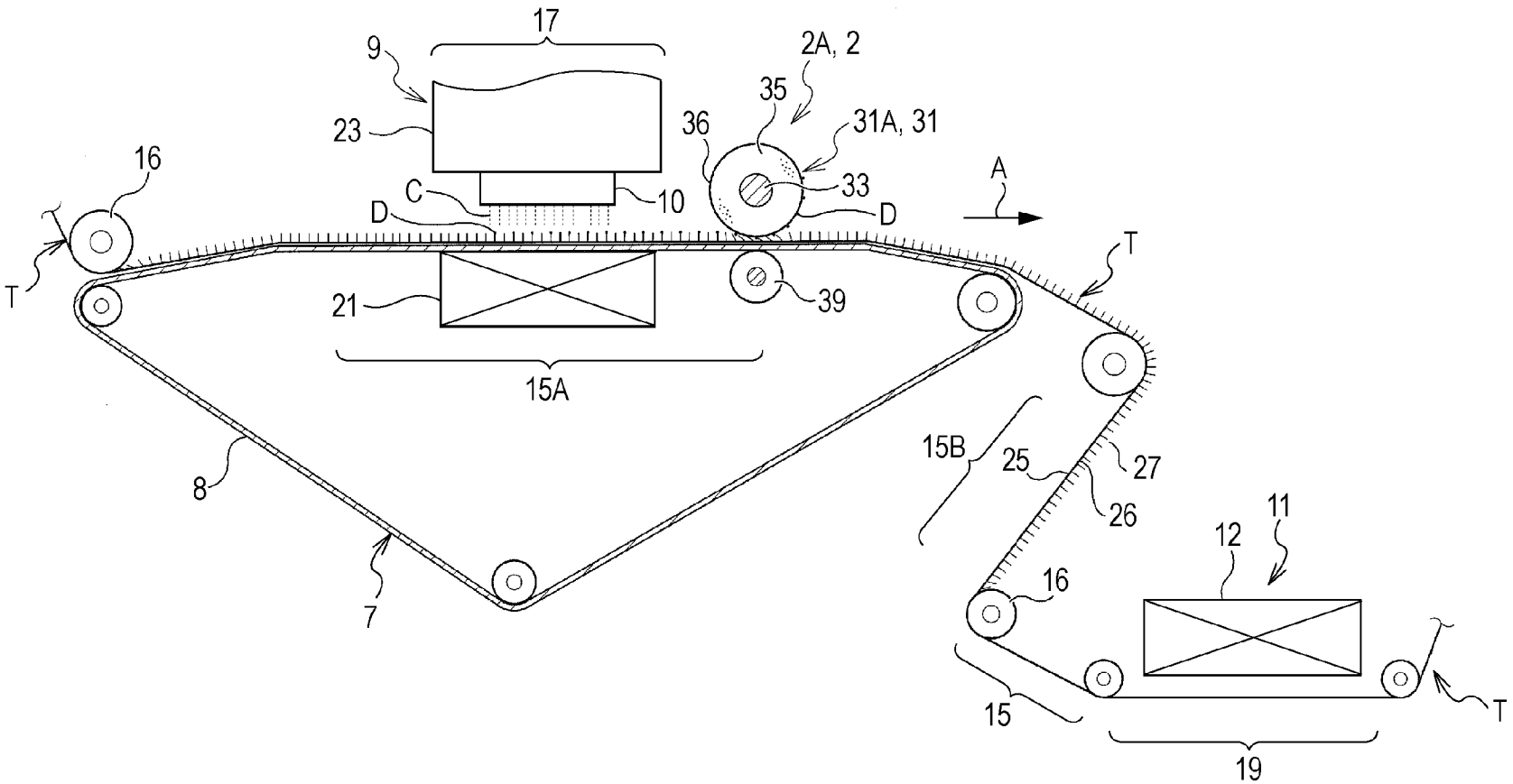
FIG. 3 is an enlarged fragmentary cross-sectional view of the ink jet printing apparatus according to the first embodiment.

Referring to the flowchart shown in FIG. 2, a control process of the printing operation according to this embodiment will be described.

First, printing is performed by the printing unit 9 on the material to be subjected to printing T (step S1). Then it is decided whether the material to be subjected to printing T has the naps 27 (step S2). This decision is made on the basis of information about the material to be subjected to printing T inputted by a user through an information input unit (not shown) of the control unit 5.

Thus, whether the material to be subjected to printing T has the naps 27 can be decided in accordance with the user's subjective judgment, and therefore although the material to be subjected to printing T may actually have the naps 27 the user may select "no nap" and proceed to subsequent steps in the case where it is not mandatory to maintain the touch or texture provided by the naps 27 or to secure high abrasion resistance.

In the case where Yes is selected at the step S2, then it is selected whether to execute removal of the ink stuck to the naps 27 (step S3). This selection is also made in accordance with selection information inputted by the user through the information input unit of the control unit 5.

In the case where the ink removal is selected at the step S3, the ink removal unit 2A is caused to perform the ink removal (step S4), and then the ink is fixed by the ink fixing unit 11.

In contrast, in the case where the ink removal is determined not to be performed at the step S3, the ink removal unit 2A remains unactivated (step S6), and the ink is fixed by the ink fixing unit 11 (step S5).

In the case where "no nap" is selected at the step S2, the ink removal unit 2A is not activated so as to remove the ink (step S6), and the ink is fixed by the ink fixing unit 11 (step S5).

Through the foregoing process, the ink removal unit 2A can be activated only when certain abrasion resistance has to be secured, and can remain unactivated when abrasion resistance is not a critical factor regardless of whether the material to be subjected to printing T has naps. Such an arrangement allows execution of a printing process free from restriction that may be imposed in the case where the ink removal unit 2A is activated, which leads, for example, to a faster printing speed.

In this embodiment, the ink removing element 31A is constituted by a driving roller 35 having a rotary shaft 33 oriented in the width direction B of the material to be subjected to printing T, the width direction B intersecting the transport direction A of the material to be subjected to printing T, and configured to be driven so as to rotate in the transport direction A of the material to be subjected to printing T at a predetermined speed.

In this embodiment, as shown in FIG. 5, the driving roller 35 is disposed so as to contact the naps 27, without contacting the surface 26 of the main structure 25 of the material to be subjected to printing T.

The main structure 25 is slightly wavy because of the nature of the fabric, and hence the surface 26 inevitably includes small recessed and protruding portions. Accordingly, the expression "without contacting the cloth structure surface" includes the state where the driving roller 35 is in slight contact with the surface 26 to such an extent that the material to be subjected to printing T can be transported substantially free from resistance, in addition to the state where the driving roller 35 is completely separated from the surface 26.

Figure 5B:
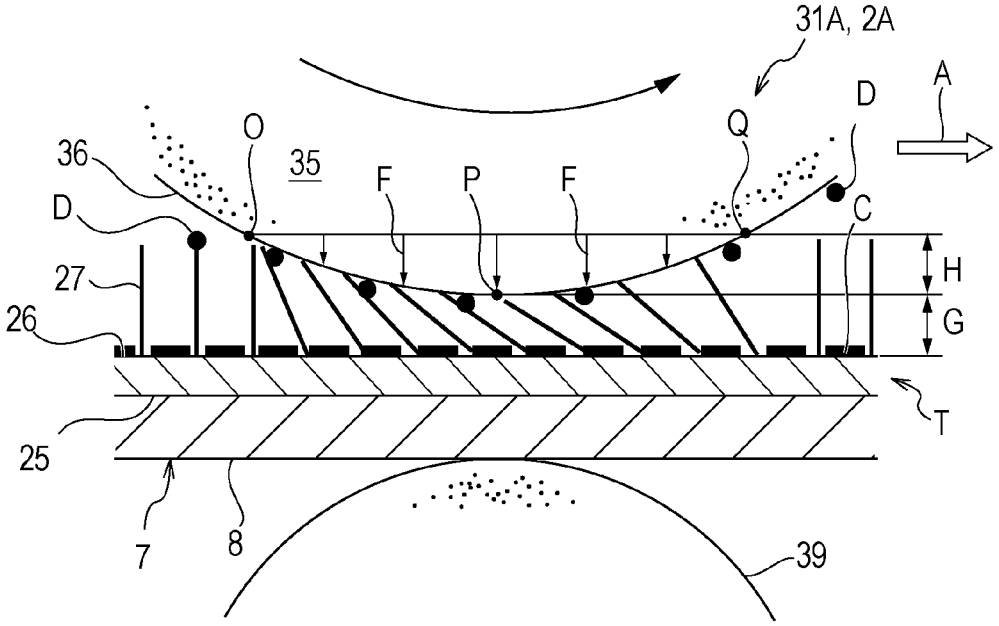
FIG. 5B is an enlarged view of a portion indicated by a circle VB in FIG. 5A.

As an effect of the driving roller 35, a contact height H of the driving roller 35 with respect to the nap 27 gradually increases from an initial contact point O toward a peak contact point P, and gradually decreases from the peak contact point P toward a last contact point Q, as shown in FIG. 5B.

In this case, the contact force F of the driving roller 35 with respect to the nap 27 gradually increases from the initial contact point O toward the peak contact point P, and gradually decreases from the peak contact point P toward the last contact point Q.

Such an arrangement prevents the naps 27 from being abruptly inclined, so that the naps 27 can gently increase the tilting angle so as to return to the original raised state after the ink lumps D are removed.

Examples of the material for the driving roller 35 include hard or soft synthetic resins, foamed synthetic resins, rubber, metals, wood, and composite materials thereof, and a cloth such as felt may be adhered around the driving roller 35.

Here, it is not mandatory that the driving roller 35 be kept from contacting the surface 26 of the main structure 25 of the material to be subjected to printing T. The driving roller 35 may be constantly in contact with the surface 26 of the main structure 25 to such an extent that the naps 27 can substantially maintain the raised state thereof.

Figure 4:
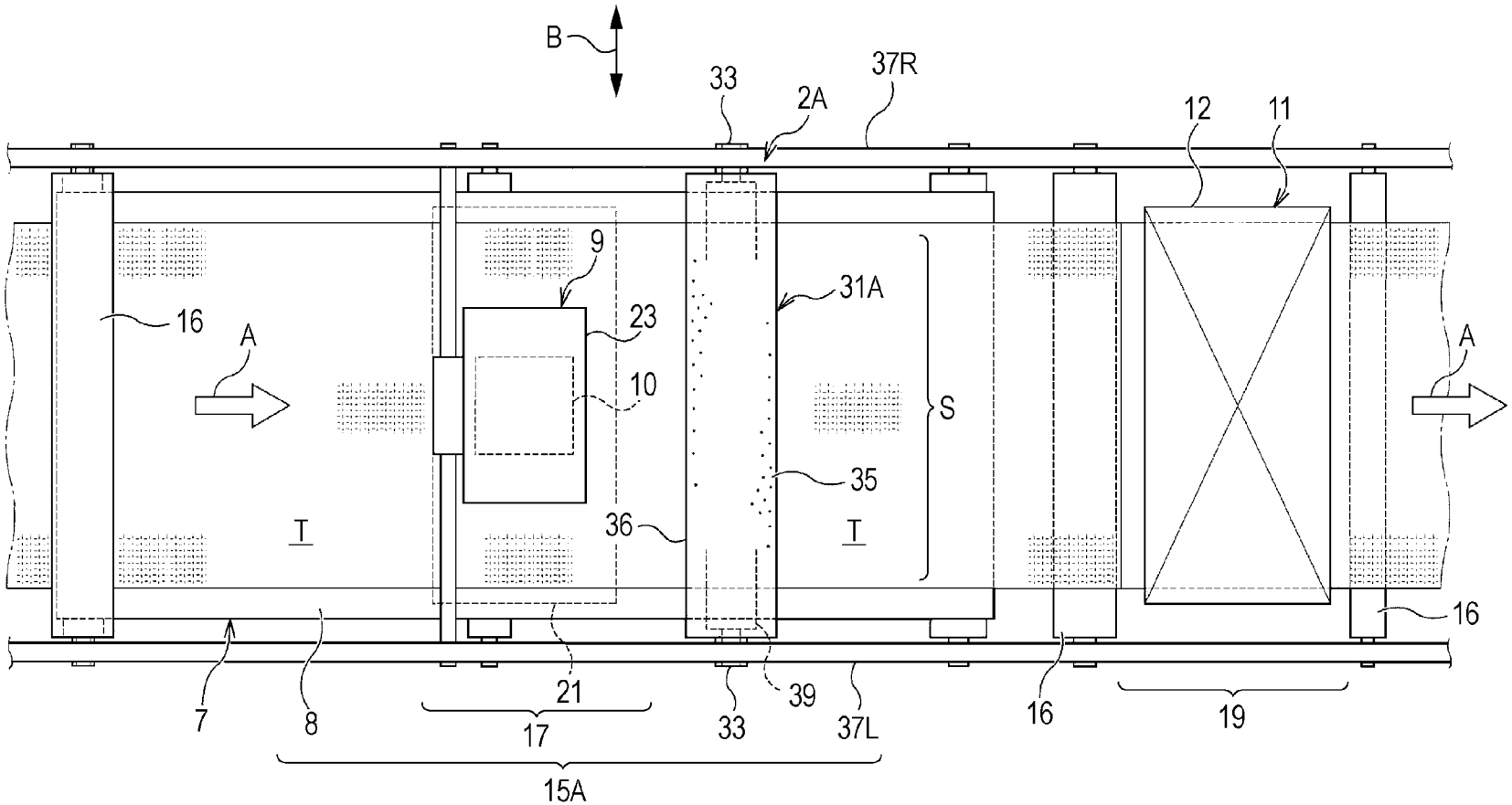
FIG. 4 is a fragmentary plan view of the ink jet printing apparatus according to the first embodiment.

The driving roller 35 may be mounted, as shown in FIG. 4, so as to horizontally span between support frames 37L, 37R provided on a left and right outer side of a printing range S in the width direction B, so that the driving roller 35 can cover the entire printing range S.

The rotation speed of the driving roller 35 can be adjusted in accordance with the type of the material to be subjected to printing T, the length and nature of the naps 27, and so forth.

For example, in the case where the driving roller 35 is set to rotate slower than the transport speed of the material to be subjected to printing T, an ink removal working surface 36 on the outer circumferential surface of the driving roller 35 is pressed against the naps 27 with a greater force, and hence the ink lumps D can be more efficiently scraped off.

In the case where the driving roller 35 is set to rotate at a speed the same as the transport speed of the material to be subjected to printing T, the ink C transferred from the nap 27 to the ink removal working surface 36 of the driving roller 35 becomes less likely to adhere again to the material to be subjected to printing T.

In the case where the driving roller 35 is set to rotate faster than the transport speed of the material to be subjected to printing T, the contact area of the driving roller 35 with respect to a unit traveling distance of the nap 27 is increased, and therefore the removal efficiency of the ink lumps D can be improved.

The rotation speed of the driving roller 35 can be selected by the user from among slower than, the same as, and faster than the transport speed of the material to be subjected to printing T, as the case may be.

In this embodiment, the driving roller 35 is located on a horizontal transport route 15A immediately downstream of the printing region 17. In addition, the ink removal unit 2A includes a support roller 39 that prevents the material to be subjected to printing T from downwardly warping while the ink lumps D are being removed from the nap 27, located so as to oppose the driving roller 35 across the horizontal transport route 15A.

Comparative Experiment

Referring now to FIG. 14, details and results of comparative tests performed for proving the effect of the ink removal unit 2A will be described.

In the comparative tests, two pieces each of specimens T1 and T2 were prepared. The specimen T1 was made by printing the material to be subjected to printing T in the same color without a blank (solid printing), removing the ink lumps D stuck to naps after printing, and then drying and solidifying the ink. The specimen T2 was not subjected to the removal of the ink lumps D before drying, and abrasion tests were performed in accordance with the test method of color fastness against abrasion specified by JIS L 0849.

A dry white cotton cloth for abrasion 41D and a wet white cotton cloth for abrasion 41W according to JIS L 0803 were respectively placed on the two types of specimens T1, T2. These specimens were set on an abrasion tester II specified by JIS L 0849, and OD values indicating extents of color migration to the white cotton cloths 41D, 41W were calculated.

The abrasion tests were performed with a load weight of 200 g, and by 100 times of reciprocations over an abrasion width of 10 cm.

As shown in FIG. 14, the OD values of the specimens T1, T2 covered with the dry white cotton cloth for abrasion 41D were 0.29 in the both cases where the ink lumps D were and were not removed, and also the appearance was barely different between the specimens.

With the wet white cotton cloth for abrasion 41W, however, the OD value was 0.33 in the case where the ink lumps D were removed and 0.55 in the case where the ink lumps D were not removed, which shows that the color migration can be effectively suppressed by removing the ink lumps D. Such difference was also visually recognized through comparison of those specimens.

Thus, the ink removal unit 2A according to this embodiment can effectively remove the unsolidified ink lumps D stuck to the naps 27 on the surface 26 of the main structure 25 of the material to be subjected to printing T, maintaining the original raised state of the naps 27.

As a result, printed goods that present both a high-quality printed design and the original touch and texture of the material can be efficiently manufactured. Further, as is apparent from the results of the comparative tests, color migration during the use of the printed goods due to residual ink lumps D can be effectively suppressed.

Second Embodiment

Figure 6:
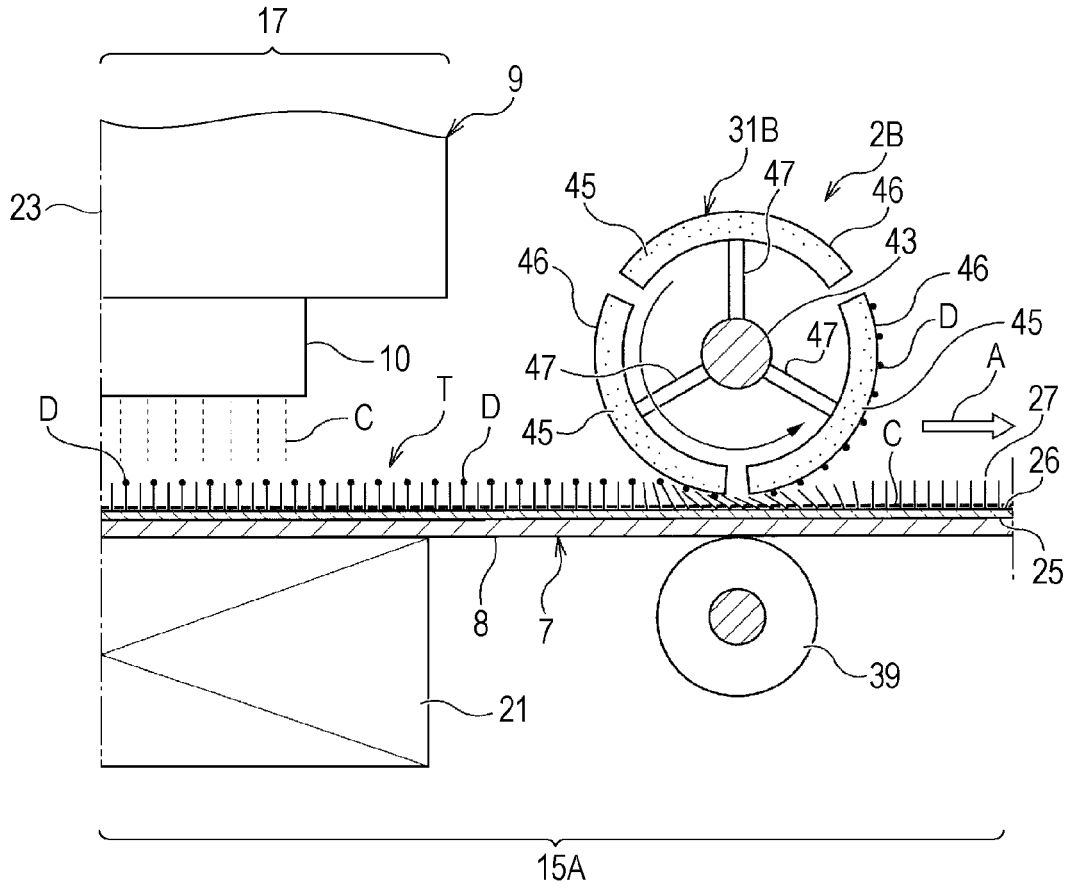
FIG. 6 is an enlarged fragmentary cross-sectional view of an ink jet printing apparatus according to a second embodiment.

In an ink removal unit 2B according to the second embodiment shown in FIG. 6, the configuration of an ink removing element 31B is different from the ink removing element 31A of the ink removal unit 2A according to the first embodiment. The structure of the remaining portion and the operation mode is generally the same as those of the ink removal unit 2A.

Accordingly, the following description will be focused on the difference from the first embodiment, namely the configuration of the ink removing element 31B.

The ink removing element 31B according to this embodiment includes, for example, three curved plate-shaped members 45, a rotary shaft 43 disposed so as to span between the left and right support frames 37L, 37R, and three connection arms 47 connecting the plate-shaped members 45 and the rotary shaft 43, thereby constituting a structure in which the ink removing element 31B rotates about the rotary shaft 43, and the outer circumferential surface of the ink removing element 31B serves as an ink removal working surface 46.

The thus-configured ink removing element 31B also offers the same advantageous effects as those offered by the first embodiment. Here, in this embodiment the rotary shaft 43 may be set to intermittently rotate instead of continuous rotation, such that the rotary shaft 43 is stopped while one of the plate-shaped members 45 is serving to remove the ink lumps D, and made to rotate by a predetermined angle (for example, 120 degrees) when the amount of the ink C stuck to the plate-shaped member 45 reaches a predetermined level.

Third Embodiment

Figure 7:
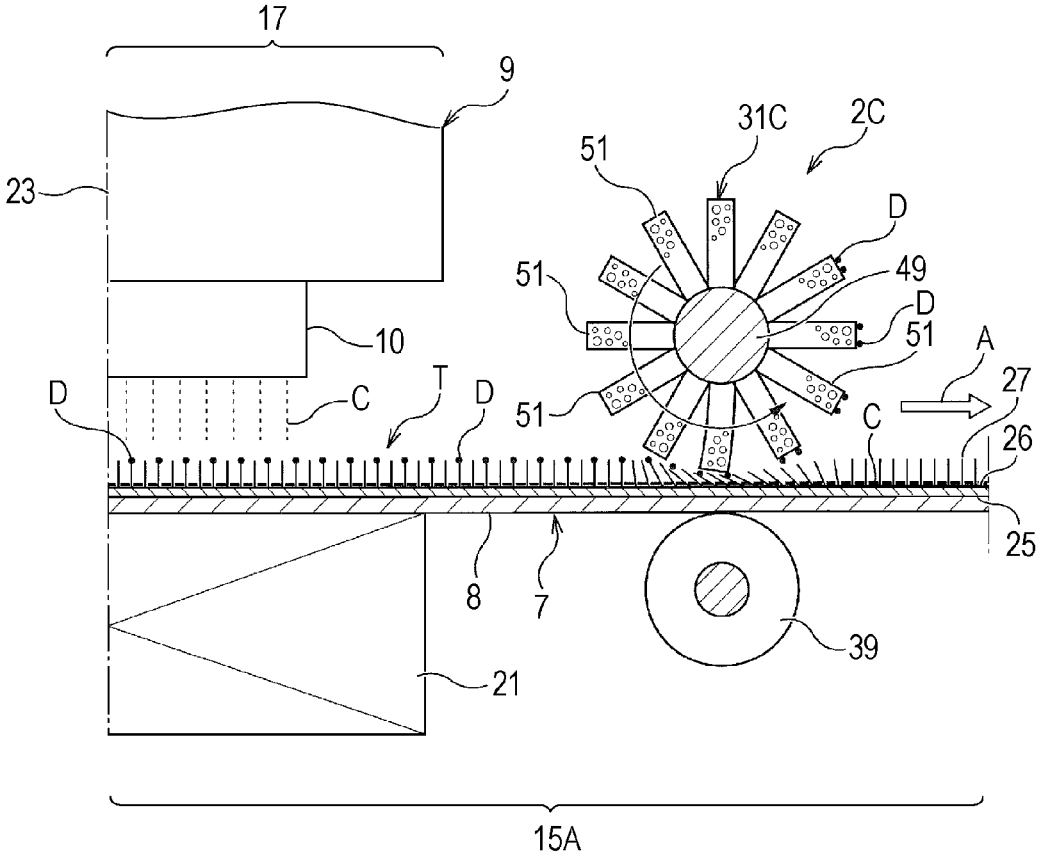
FIG. 7 is an enlarged fragmentary cross-sectional view of an ink jet printing apparatus according to a third embodiment.

In an ink removal unit 2C according to the third embodiment shown in FIG. 7, the configuration of an ink removing element 31C is different from the ink removing element 31A of the ink removal unit 2A according to the first embodiment. The structure of the remaining portion and the operation mode is generally the same as those of the ink removal unit 2A.

Accordingly, the following description will be focused on the difference from the first embodiment, namely the configuration of the ink removing element 31C.

In this embodiment, the ink removing element 31C includes a rotary shaft 49 disposed so as to span between the left and right support frames 37L, 37R, and a plurality of rod-shaped members 51 located around the rotary shaft 49 so as to radially extend therefrom.

The rod-shaped members 51 are, for example, formed of a foamed body of a soft synthetic resin, so as to be elastically deformed slightly, upon contacting the naps 27 on the material to be subjected to printing T.

The thus-configured ink removing element 31C also offers the same advantageous effects as those offered by the first embodiment, with an additional advantage in that the elastic deformation of the rod-shaped member 51 serves to reduce the load imposed on the naps 27 when the ink lumps D are removed.

Further, reducing the diameter of the rod-shaped members 51 and increase the number thereof allows the ink removing element 31C to act like a rotary brush.

Fourth Embodiment

Figure 8:
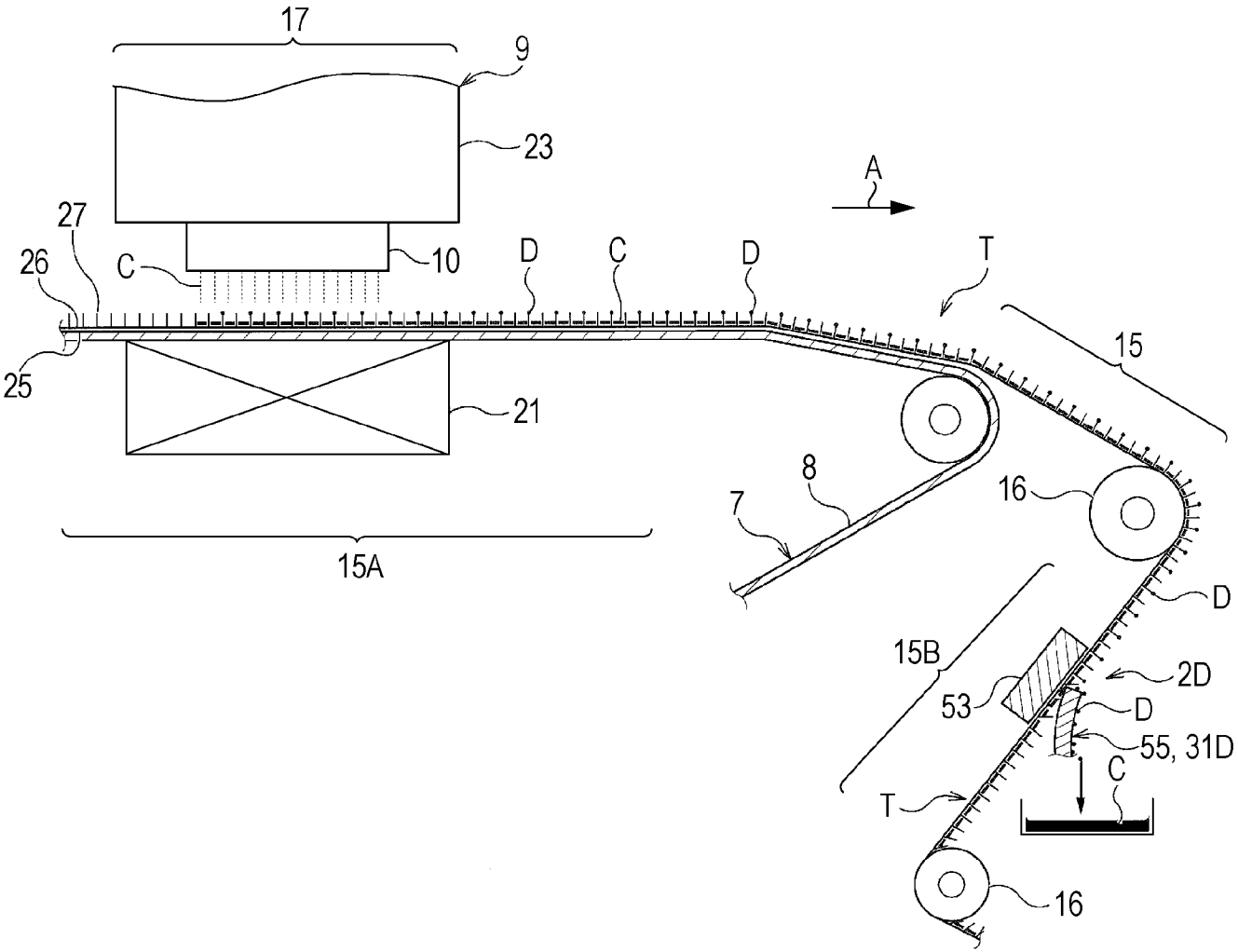
FIG. 8 is a fragmentary cross-sectional view of an ink jet printing apparatus according to a fourth embodiment.

In an ink removal unit 2D according to the fourth embodiment shown in FIG. 8, the configuration of an ink removing element 31D and the location of the ink removal unit 2D are different from the ink removal unit 2A according to the first embodiment. Specifically, the ink removal unit 2D includes a plate-shaped support member 53 instead of the support roller 39 employed in the first embodiment.

In this embodiment, the ink removing element 31D is constituted by a blade-shaped scraper 55 obliquely disposed in a scraping direction as shown in FIG. 8, and the support member 53 that prevents the material to be subjected to printing T from warping while the ink lumps D are being scraped off is located so as to oppose the scraper 55 across the transport route 15.

The scraper 55 and the support member 53 are slightly wider than a widest material to be subjected to printing T applicable to the ink jet printing apparatus 1. A gap G between the leading edge of the scraper 55 and the surface 26 of the main structure 25 is set in the same manner as in other embodiments so as to maintain the raised state of the naps 27. Likewise, examples of the material for the scraper 55 include hard or soft synthetic resins, foamed synthetic resins, rubber, metals, wood, and composite materials thereof, and a cloth such as felt may be adhered to the scraper 55.

In this embodiment, further, the ink removal unit 2D is located in an obliquely reversed transport route 15B between the printing region 17 and the drying region 19 where the print-side surface of the material to be subjected to printing T is oriented downward as shown in FIG. 8. Alternatively, the ink removal unit 2D may be located in a horizontally reversed transport route (not shown) where the print-side surface is oriented vertically downward.

The thus-configured ink removal unit 2D also offers the same advantageous effects as those offered by the first embodiment, with an additional advantage in that, since the ink C scraped off by the ink removal unit 2D flows downward along the scraper 55, the removed ink C is prevented from adhering again to the material to be subjected to printing T, and can be easily collected.

Fifth Embodiment

Figure 9:
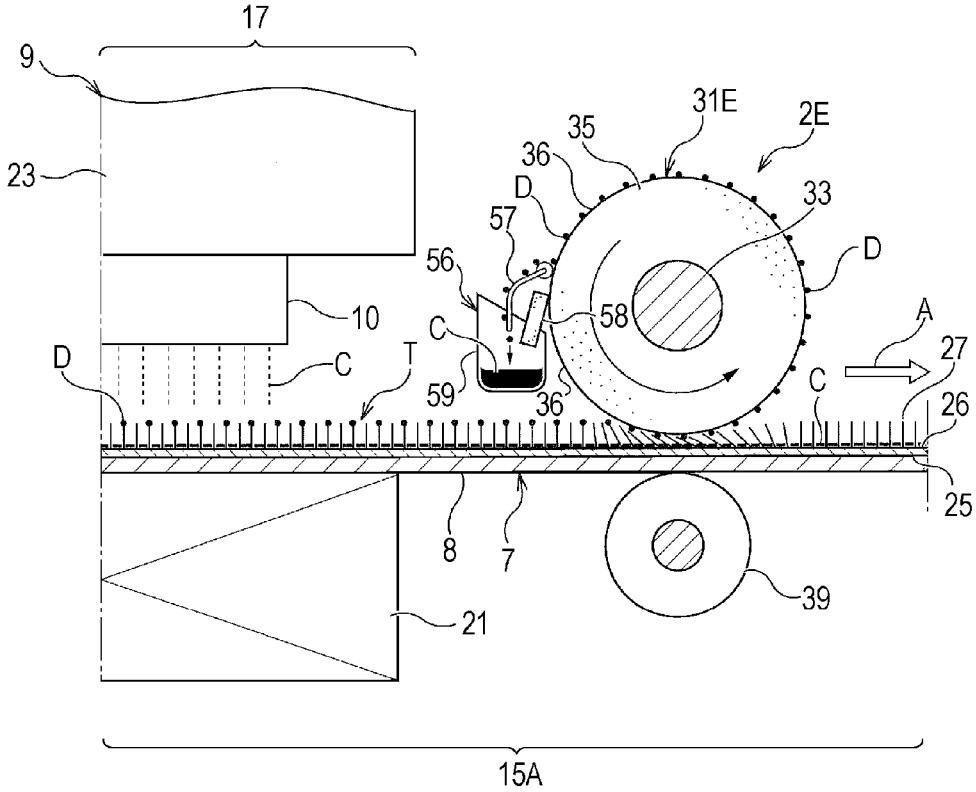
FIG. 9 is an enlarged fragmentary cross-sectional view of an ink jet printing apparatus according to a fifth embodiment.

The ink removal unit 2E according to the fifth embodiment shown in FIG. 9 has generally the same configuration as the ink removal unit 2A according to the first embodiment, and includes an ink removing element 31E constituted by the driving roller 35 as the ink removing element 31A according to the first embodiment.

The ink removal unit 2E additionally includes a cleaning mechanism 56 including a scraping element 57 that contacts a part of the outer circumferential surface of the driving roller 35 so as to scrape off the ink C stuck to the ink removal working surface 36, a cleaning pad 58 that wipes and cleans the ink removal working surface 36 from which the ink C has been removed, and a reservoir tank 59 in which the ink C scraped off by the scraping element 57 is stored.

The thus-configured ink removal unit 2E also offers the same advantageous effects as those offered by the first embodiment. In addition, the cleaning mechanism 56 serves to clean the ink removal working surface 36 of the driving roller 35 so as to make the driving roller 35 ready to fully collect the ink lumps D, thereby allowing the driving roller 35 to operate substantially free from a maintenance work.

Sixth Embodiment

Figure 10:
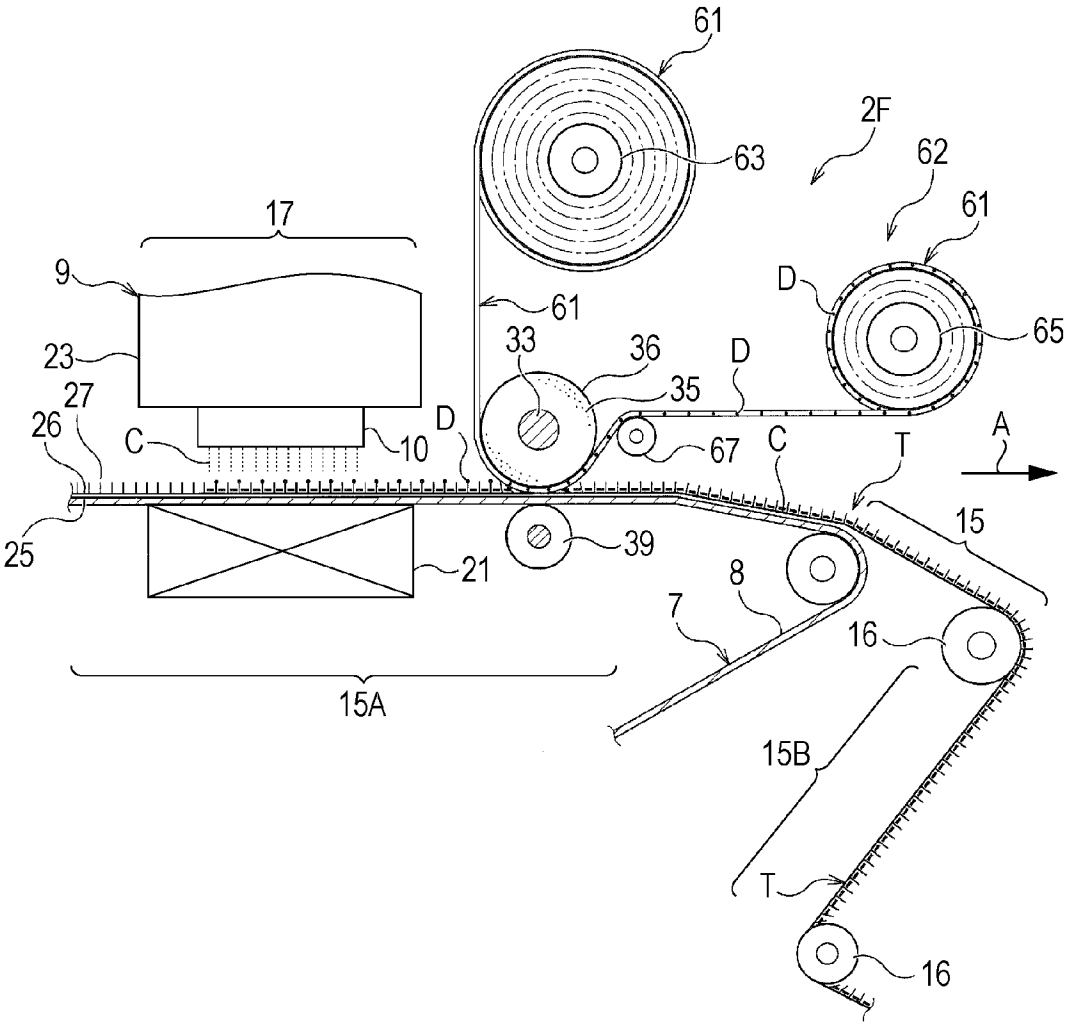
FIG. 10 is a fragmentary cross-sectional view of an ink jet printing apparatus according to a sixth embodiment.

An ink removal unit 2F according to the sixth embodiment shown in FIG. 10 includes a soft sheet 61 capable of absorbing the ink C, and a sheet transport device 62 that transports the soft sheet 61 in the transport direction A of the material to be subjected to printing T, while keeping the soft sheet 61 in contact with the naps 27 of the material to be subjected to printing T.

The sheet transport device 62 may be configured to transport a lengthy soft sheet 61 wound in a roll, and may include for example a feed roller 63 different from the feed roller 4 for the material to be subjected to printing T, a takeup roller 65 different from the takeup roller 14 for the material to be subjected to printing T, a guide roller 67 that winds the soft sheet 61 around the driving roller 35 over a predetermined distance, and the soft sheet 61, so as to transport the soft sheet 61 at the same speed as the traveling speed of the material to be subjected to printing T.

The thus-configured ink removal unit 2F can also effectively remove the ink lumps D stuck to the naps. In this embodiment, further, actually the soft sheet 61 serves to remove the ink lumps D, such that the ink lumps D are continuously absorbed by the soft sheet 61 over the available length thereof. Upon feeding the entire length of the soft sheet 61 a replacement roll of the soft sheet 61 can be provided, and therefore the ink removal unit 2F can continue utilizing the driving roller 35 substantially without the need of a maintenance work.

Since the driving roller 35 does not make a direct contact with the naps 27 in this embodiment, the driving roller 35 may merely be a guide roller without the ink removal function.

According to this embodiment, further, the sheet transport device 62 transports the soft sheet 61 capable of absorbing the ink C in the transport direction A of the material to be subjected to printing T, while keeping the soft sheet 61 in contact with the naps 27 of the material to be subjected to printing T. Accordingly, the ink lumps D stuck to the nap 27 is absorbed by the soft sheet 61 thus to be removed. In addition, the soft sheet 61 gradually shifts the working portion of the ink-absorbing surface in the transport direction A of the material to be subjected to printing T, so that the ink-absorbing position of the soft sheet 61 is renewed while contacting the naps 27, so as to efficiently absorb the ink lumps 27 from the naps 27.

Further, since the soft sheet 61 renews the ink-absorbing position while being transported in contact with the naps 27 as mentioned above, the soft sheet 61 can absorb the ink lumps D through a light contact with the naps 27, thereby facilitating the naps 27 to maintain the original raised state.

Seventh Embodiment

Figure 11:
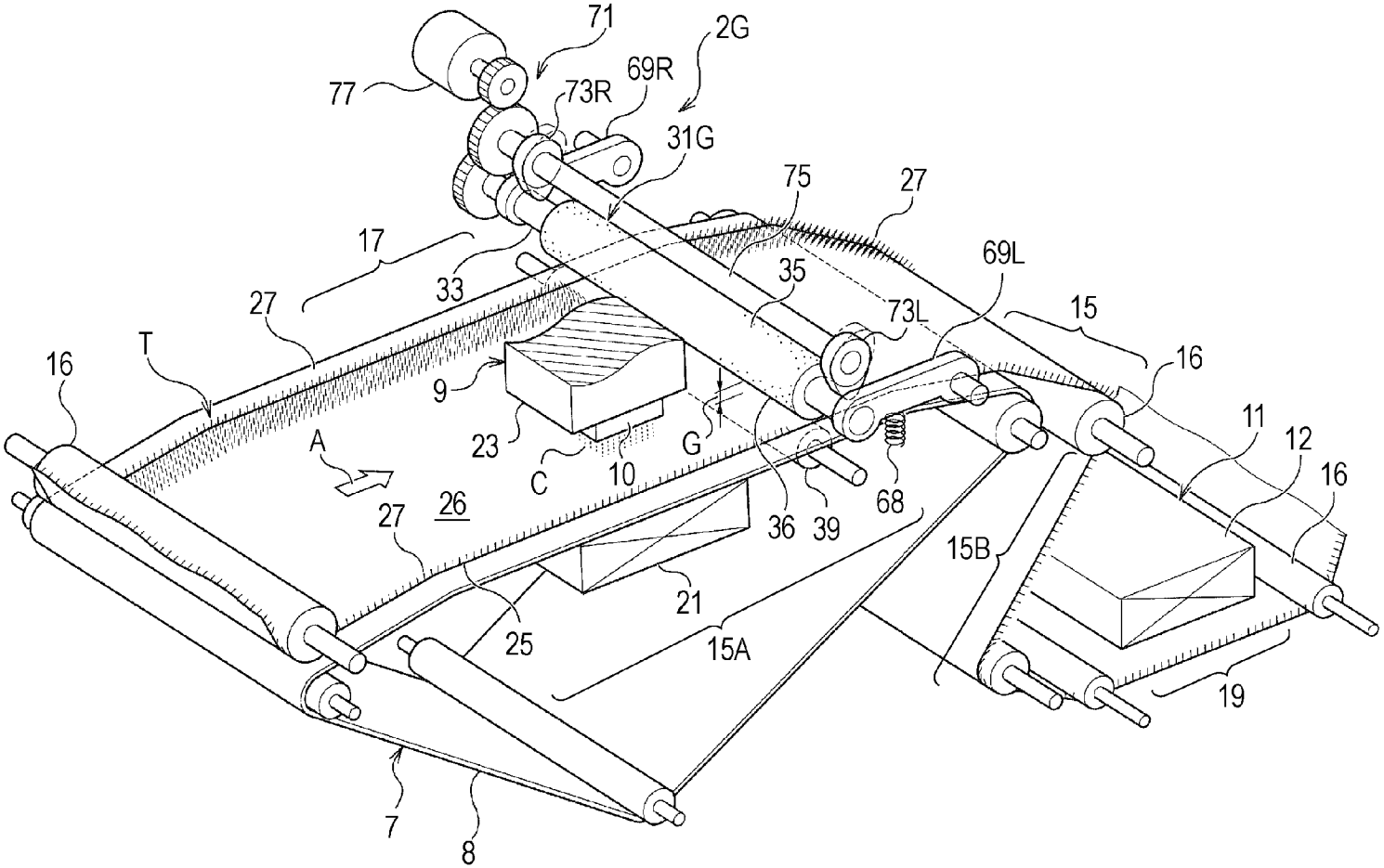
FIG. 11 is a fragmentary perspective view of an ink jet printing apparatus according to a seventh embodiment.

The ink removal unit 2G according to the seventh embodiment shown in FIG. 11 has generally the same configuration as the ink removal unit 2A according to the first embodiment, and includes an ink removing element 31G constituted by the driving roller 35 and the rotary shaft 33 as the ink removing element 31A according to the first embodiment.

In this embodiment, the gap G between the ink removal working surface 36 of the driving roller 35 and the surface 26 of the main structure 25 of the material to be subjected to printing T can be adjusted by an adjustment mechanism 71.

The adjustment mechanism 71 may be constituted by various systems configured to move the rotary shaft 33 of the driving roller 35 up and down while keeping it horizontal. For example, as shown in FIG. 11, the adjustment mechanism 71 may include a pair of swinging arms 69L, 69R supporting the driving roller 35 and biased upward by a biasing member 68, and a cam mechanism including a left and right pair of cams 73L, 73R, a driving shaft 75 that drives the cams 73L, 73R, and a motor 77 that rotates the driving shaft 75, to thereby adjust the gap G.

The adjustment mechanism 71 is configured to operate in accordance with a control signal outputted by the control unit 5 on the basis of information inputted by the user through the information input unit.

The thus-configured ink removal unit 2G also offers the same advantageous effects as those offered by the first embodiment. In addition, according to this embodiment the adjustment mechanism 71 enables the ink jet printing apparatus 1 to accept various materials to be subjected to printing T having different natures and nap lengths, by adjusting the gap G.

Alternatively, the adjustment mechanism 71 may include a rack and pinion mechanism, a screw mechanism operated by manually rotating a knob, and the like.

Eighth Embodiment

Figure 12:
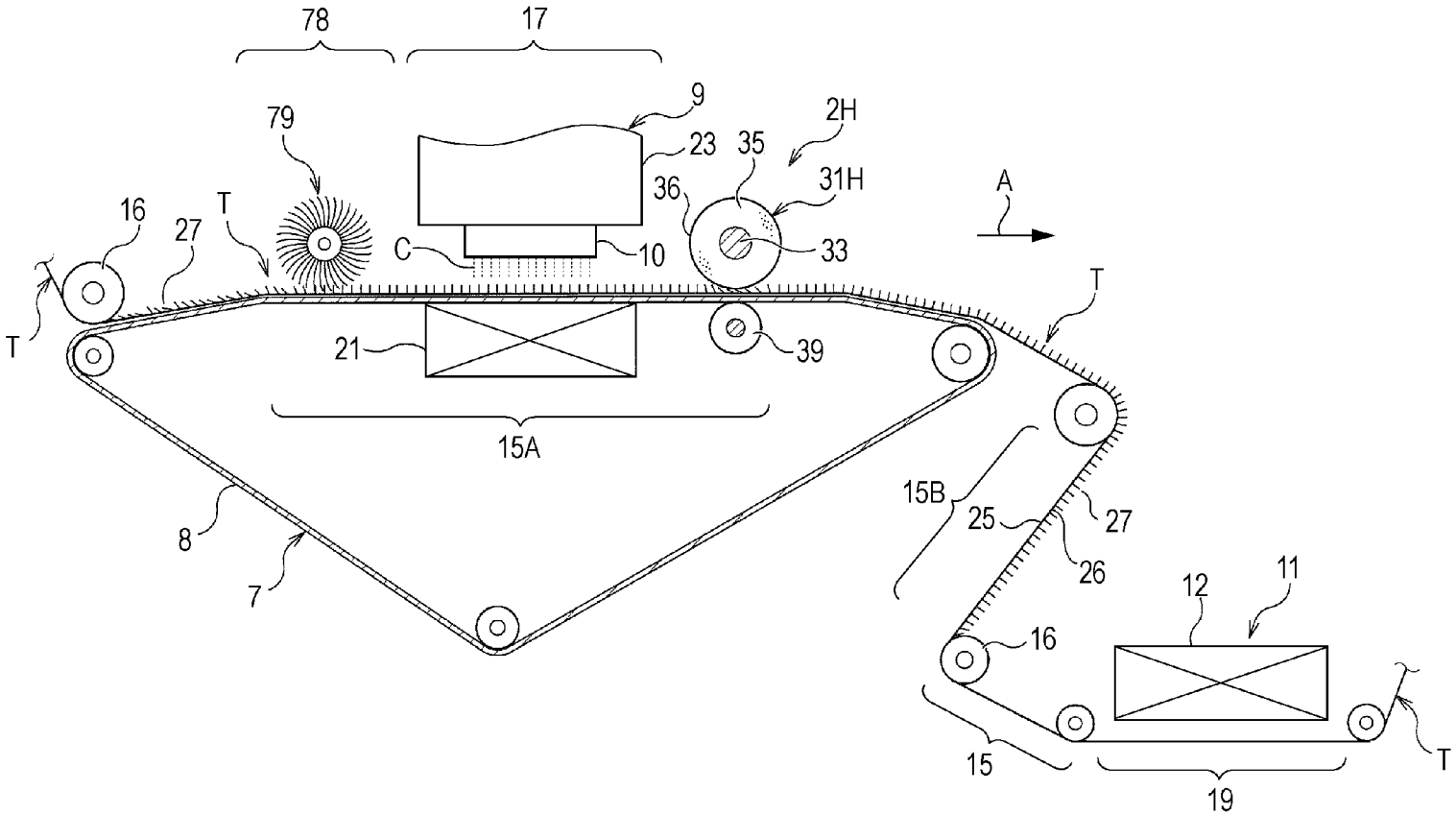
FIG. 12 is a fragmentary cross-sectional view of an ink jet printing apparatus according to an eighth embodiment.

The ink removal unit 2H according to the eighth embodiment shown in FIG. 12 has generally the same configuration as the ink removal unit 2A according to the first embodiment, and includes an ink removing element 31H constituted by the driving roller 35 as the ink removing element 31A according to the first embodiment.

However, this embodiment is different from the first embodiment in that a nap raising region 78 including a nap raising device 79 is provided upstream of the printing region 17 for the material to be subjected to printing T.

The nap raising device 79 serves to rectify the naps 27 on the surface 26 of the main structure 25 into an orderly raised state in advance of printing, in the case where the naps 27 of the material to be subjected to printing T transported on the conveyor belt 8 are collapsed or entangled with adjacent naps.

The nap raising device 79 can be typically exemplified by a rotary brush as shown in FIG. 12.

The thus-configured ink removal unit 2H also offers the same advantageous effects as those offered by the first embodiment.

According to this embodiment, further, the nap raising device 79 raises the naps 27 of the material to be subjected to printing T so as to improve the uniformity of the raised state of naps 27, before the ink is discharged to the print-side surface of the material to be subjected to printing T. Such an arrangement reduces influence of uneven raised state of naps 27, when ink droplets land on the print-side surface of the material to be subjected to printing T having the naps 27. In other words, uniformity in landing performance of the ink droplets on the naps 27 and the cloth structure surface can be improved.

In the case where the material to be subjected to printing T has a relatively small amount of naps 27, it can be expected that majority of the discharged ink directly lands on the surface 26 without being disturbed by the naps 27. Accordingly, the printing quality can be improved, and also the number of ink lumps D formed on the naps 27 is reduced and hence the workload of the ink removing element 31H for removing the ink is reduced, which leads to higher ink removing efficiency.

Ninth Embodiment

In the ink jet printing apparatus 1 according to the ninth embodiment, the printing head 10 is constituted by a line head (hereinafter referred to as "printing line head"). An ink removal unit 2I includes an ink removing element 31I attached to a downstream side end face 10E of the printing line head 10 in the transport direction A of the material to be subjected to printing T.

The ink removing element 31I is constituted by a blade-shaped scraper 55, and the support member 53, for example of a plate shape, is located under the scraper 55 with the material to be subjected to printing T and the conveyor belt 8 therebetween.

In this embodiment, the scraper 55 and the support member 53 have generally the same width as the printing line head 10. The gap G between the leading edge 55*a* of the scraper 55 and the surface 26 of the main structure 25 is set in the same manner as in other embodiments. Likewise, examples of the material for the scraper 55 include hard or soft synthetic resins, foamed synthetic resins, rubber, metals, wood, and composite materials thereof, and a cloth such as felt capable of absorbing the ink may be adhered to the scraper 55.

To remove the ink lumps D stuck to the naps 27 with the thus-configured ink removal unit 2I, the material to be subjected to printing T driven by the conveyor belt 8 so as to move in the transport direction A sequentially brings the naps 27 into contact with the scraper 55, so that the ink lumps D are removed from the naps 27.

Additional Embodiments

Although exemplary embodiments of the ink jet printing apparatus 1, the ink removal unit 2, and the method of manufacturing printed goods by the ink jet printing process have been described, it is a matter of course that various modifications may be made within the scope and spirit of the invention.

For example, the driving roller 35, the plate-shaped members 45 and the rod-shaped members 51 may be set to rotate in a direction opposite to the transport direction A of the material to be subjected to printing T, or fixed immobile, instead of rotating in the same direction as the transport direction A.

The cleaning mechanism 56 may also be configured differently from the foregoing embodiment. For example, the driving roller 35, the plate-shaped members 45, the rod-shaped members 51, or the scraper 55 may include suction holes, and a suction device such as a suction fan may be provided outside so as to remove the ink C stuck to the ink removing element 31.

For example, the support roller 39 located so as to oppose the ink removing element 31 across the transport route 15 of the material to be subjected to printing T may be set to rotate following the movement of the material to be subjected to printing T being transported, or to be driven so as to rotate at the same speed as the conveyor belt 8 by the driving force thereof.

Further, the support member 53 employed in the fourth embodiment in place of the support roller 39 may have a curved plate shape, instead of the flat plate shape.

Further, although the ink removing element 31 is provided over the entire printing range S so as to serve for the material to be subjected to printing T of any width, the ink removing element 31 may be provided so as to cover only a part of the printing range S, in a specific model that performs printing in a limited printing range.

Further, the ink removal unit 2 may be supported by the printing head 10 or the carriage 23, instead of the left and right support frames 37L, 37R and the left and right swinging arms 69L, 69R provided downstream of the printing region 17 in the transport direction A of the material to be subjected to printing T.

What is claimed is:

1. An ink jet printing apparatus comprising:

a printing unit having a printing head that discharges an ink onto a material, wherein the material is a cloth having a nap on a cloth structure surface thereof;

an ink fixing unit that fixes the ink discharged onto the material, the fixing unit being located downstream of the printing unit in a transport direction; and an ink removal unit that removes unfixed ink stuck to the nap before the unfixed ink is fixed by the ink fixing unit.

2. The ink jet printing apparatus according to claim 1, further comprising a control unit that controls an operation of the ink removal unit, wherein the control unit is configured to select whether to execute ink removal by using the ink removal unit.

3. The ink jet printing apparatus according to claim 1, further comprising a control unit that controls an operation of the ink removal unit, wherein the ink removal unit includes an ink removing element that contacts the nap, wherein a gap between the ink removing element and the cloth structure surface of the material is adjustable by manual operation or by a control signal from the control unit.

4. The ink jet printing apparatus according to claim 1, wherein the ink removal unit includes an ink removing element that contacts the nap.

5. The ink jet printing apparatus according to claim 4, wherein a contact height of the ink removing element with respect to the nap is arranged so as to gradually increase from an initial contact point toward a peak contact point, and to gradually decrease from the peak contact point toward a last contact point.

6. The ink jet printing apparatus according to claim 5, wherein the ink removing element includes a roller having a rotary shaft oriented in a direction intersecting the transport direction.

7. The ink jet printing apparatus according to claim 6, wherein the roller includes a driving roller which is driven so as to rotate in the transport direction at a predetermined speed.

8. The ink jet printing apparatus according to claim 1, wherein the ink removing unit is provided on a transport route where a print-side surface of the material is oriented downward.

9. The ink jet printing apparatus according to claim 1, further comprising a cleaning mechanism that removes ink stuck to the ink removing unit.

10. The ink jet printing apparatus according to claim 1, wherein the ink removal unit includes a soft sheet capable of absorbing ink.

11. The ink jet printing apparatus according to claim 10, wherein a sheet transport device transports the soft sheet in the transport direction of the material while keeping the soft sheet in contact with the nap of the material.

12. The ink jet printing apparatus according to claim 1, further comprising a nap raising device located upstream of the printing unit and configured to raise the nap of the material.

13. The ink jet printing apparatus according to claim 1, wherein the ink removal unit includes an ink removing element that contacts the nap, wherein the ink removing element is located between the printing unit and the ink fixing unit in the transport direction.

14. The ink jet printing apparatus according to claim 13, wherein the ink removing element is attached to the printing head or a carriage which holds the printing head.

15. A method of manufacturing printed goods by an ink jet printing process, comprising:

discharging an ink onto a material which is a cloth having a nap on a cloth structure surface;

removing unfixed ink stuck to the nap; and fixing the ink applied to the material after removing the unfixed ink from the nap.

* * * * *